US009152110B2

(12) United States Patent
Miura et al.

(10) Patent No.: US 9,152,110 B2
(45) Date of Patent: Oct. 6, 2015

(54) PRESSURE ROTATING MEMBER, METHOD FOR MANUFACTURING THE SAME, AND HEATING DEVICE

(71) Applicant: CANON KABUSHIKI KAISHA, Tokyo (JP)

(72) Inventors: Jun Miura, Kawasaki (JP); Yutaka Arai, Kawasaki (JP)

(73) Assignee: Canon Kabushiki Kiasha, Tokyo (JP)

( * ) Notice: Subject to any disclaimer, the term of this patent is extended or adjusted under 35 U.S.C. 154(b) by 0 days.

(21) Appl. No.: 14/310,345

(22) Filed: Jun. 20, 2014

(65) Prior Publication Data

US 2014/0301763 A1 Oct. 9, 2014

Related U.S. Application Data

(63) Continuation of application No. PCT/JP2014/000129, filed on Jan. 14, 2014.

(30) Foreign Application Priority Data

Jan. 18, 2013 (JP) ..... 2013-007471
Dec. 4, 2013 (JP) ..... 2013-251150
Jan. 10, 2014 (JP) ..... 2014-003389

(51) Int. Cl.
*G03G 15/20* (2006.01)

(52) U.S. Cl.
CPC ..... *G03G 15/206* (2013.01); *G03G 15/2057* (2013.01); *G03G 2215/2035* (2013.01)

(58) Field of Classification Search
CPC ..... G03G 15/2053; G03G 15/2057; G03G 15/2039; G03G 15/206; G03G 15/2064; G03G 15/2035; G03G 2215/2048; G03G 15/1625; G03G 15/2025; G03G 15/2089; G03G 2215/2032; G03G 15/2042; G03G 15/657
See application file for complete search history.

(56) References Cited

U.S. PATENT DOCUMENTS 6,952,553 B2 10/2005 Sakakibara et al.
8,005,413 B2 8/2011 Sakakibara et al.
(Continued)

FOREIGN PATENT DOCUMENTS

JP 2001-265147 A 9/2001
JP 2002-114860 A 4/2002
(Continued)

OTHER PUBLICATIONS

International Search Report in International Application No. PCT/JP2014/000129 (dated Feb. 25, 2014).
International Preliminary Report on Patentability in International Application No. PCT/JP2014/000129 (issued Jul. 21, 2015).

*Primary Examiner* — Roy Y Yi
(74) *Attorney, Agent, or Firm* — Fitzpatrick, Cella, Harper & Scinto

(57) ABSTRACT

The present invention relates to a pressure rotating member which achieves the shortening of a warm-up time while suppressing a non-recording material-contacting area's temperature rise. The pressure rotating member which is used in a thermal fixing apparatus includes: a substrate; and an elastic layer that is formed on the substrate and has a void, wherein the elastic layer contains a needle-shaped filler, wherein the needle-shaped filler has such a thermal conductivity λ1 of the elastic layer in a direction along a rotary axis of the pressure rotating member as to be 6 times or more and 900 times or less of a thermal conductivity λ2 of the elastic layer in a thickness direction.

11 Claims, 6 Drawing Sheets

(56) References Cited

U.S. PATENT DOCUMENTS

| | | | | |
|---|---|---|---|---|
| 8,224,223 | B2 | 7/2012 | Sakakibara et al. | |
| 8,369,763 | B2 | 2/2013 | Sakakibara et al. | |
| 8,401,450 | B2 | 3/2013 | Sekihara et al. | |
| 8,626,046 | B2 | 1/2014 | Sekihara et al. | |
| 8,688,023 | B2 | 4/2014 | Sekihara et al. | |
| 8,755,726 | B2 | 6/2014 | Sugimoto | |
| 2007/0111873 | A1* | 5/2007 | Ito et al. | 492/56 |
| 2011/0197962 | A1* | 8/2011 | Kawakami | 136/256 |
| 2012/0269560 | A1 | 10/2012 | Sakakibara | |
| 2014/0105659 | A1 | 4/2014 | Miyahara | |
| 2014/0133892 | A1 | 5/2014 | Miura et al. | |
| 2014/0248071 | A1 | 9/2014 | Matsunaka et al. | |

FOREIGN PATENT DOCUMENTS

| | | | |
|---|---|---|---|
| JP | 2002-351243 | A | 12/2002 |
| JP | 2004-139026 | A | 5/2004 |
| JP | 2008-150552 | A | 7/2008 |
| JP | 2011-85846 | A | 4/2011 |
| JP | 2012-37874 | A | 2/2012 |
| JP | 2012-234151 | A | 11/2012 |
| WO | 2014/097616 | A1 | 6/2014 |
| WO | 2014/103252 | A1 | 7/2014 |
| WO | 2014/103263 | A1 | 7/2014 |

* cited by examiner

PRESSURE ROTATING MEMBER, METHOD FOR MANUFACTURING THE SAME, AND HEATING DEVICE

CROSS-REFERENCE TO RELATED APPLICATIONS

This application is a continuation of International Application No. PCT/JP2014/000129, filed Jan. 14, 2014, which claims the benefit of Japanese Patent Application No. 2013-007471, filed Jan. 18, 2013, Japanese Patent Application No. 2013-251150, filed Dec. 4, 2013, and Japanese Patent Application No. 2014-003389, filed Jan. 10, 2014.

BACKGROUND OF THE INVENTION

1. Field of the Invention

The present invention relates to a pressure rotating member which is used in a heating device such as a thermal fixing apparatus that clamps a material to be heated therebetween and conveys the material therethrough to heat the material; a method for manufacturing the same; and a heating device using the same.

2. Description of the Related Art

In an electrographic apparatus, a heating device is used which includes a heating member and a pressurizing member that is arranged so as to face the heating member, as a heating device for fixing an unfixed toner image which has been formed on a recording material, on the recording material.

When such a heating device is made to adapt to the recording materials having various sizes, it becomes a problem that temperature rises in a region of the heating member, with which a recording material having a small size (for instance, A-4 size paper) does not come in contact. A specific example of such a region includes an end region in a cross direction of the heating member. This problem is occasionally referred to as "non-recording material-contacting area's temperature rise."

Specifically, when a recording material having a relatively smaller width than the width of the heating member of a fixing apparatus continuously passes through a nipping portion formed of the heating member and the pressurizing member, a temperature in the region rises with which the recording material in the nip does not come in contact. This phenomenon occurs because the heat transferred from the heating member is not absorbed by the recording material and/or toner on the recording material, in the region with which the recording material in the nip does not come in contact.

Such a phenomenon occasionally causes the deterioration and/or deformation of the pressurizing member and the heating member. In addition, when paper having a large size passes through the nip which is in such a state that the temperature in the region has excessively risen with which paper having a small size does not come in contact, the toner on the paper having the large size is excessively melted, and offset occasionally occurs.

Such a problem more easily occurs as the speed (process speed) of the image output of a printer increases. Specifically, a period of time during which the recording material passes through the nip becomes shorter as the speed of the image output becomes higher, and accordingly the heating member needs to transfer sufficient heat to the toner image in a shorter period of time. The above problem occurs because the temperature of a fixing roller needs to be set at higher temperature for the sufficient heat transfer.

On the other hand, in an electrophotographic image-forming apparatus, it is desired to shorten a period of time necessary for the output of a first image after startup (hereinafter referred to as "first printout time"), and further shorten a period of time for raising the temperature of the nipping portion of the heating device to a temperature necessary for fixing the toner (hereinafter also referred to as "warm-up time") in order to reduce power consumption.

For this reason, it is performed to reduce thermal conduction by making the elastic layer of the pressurizing member contain a void. Specifically, a heat quantity to be transferred to the pressurizing member from the heating member when the operation of the heating device is started is controlled to be small, and a speed of the temperature rise of the heating member is enhanced by the reduction of the thermal conduction of the pressurizing member.

Here, the following three methods are known as methods for forming the elastic layer having the void therein.

In Japanese Patent Application Laid-Open No. 2008-150552, a foaming agent is mixed into uncrosslinked silicone rubber to cause foaming and cure in the silicone rubber, and thereby the void is formed therein. In Japanese Patent Application Laid-Open No. 2001-265147, a hollow filler is previously mixed into uncrosslinked silicone rubber to thereby form the void after the uncrosslinked silicone rubber has been molded and cross-linked. In addition, in Japanese Patent Application Laid-Open No. 2002-114860, a water-absorbing polymer in which water is absorbed is dispersed in uncrosslinked silicone rubber, and the void is formed by a dehydration reaction occurring when the uncrosslinked silicone rubber is cross-linked. However, the reduction of the thermal conduction of the pressurizing member results in further causing the acceleration of the temperature rise in a noncontact region of the recording material having the small size in the previously described nip.

Accordingly, it has been difficult to balance the reduction of the non-recording material-contacting area's temperature rise in the nip with the shortening of the warm-up time of the nip.

Incidentally, in Japanese Patent Application Laid-Open No. 2002-351243, a high thermally-conductive rubber composite is used in which a fibrous filler is blended into the elastic layer of the pressure rotating member to enhance the thermal conduction in the rotational axis direction of the member, and it is attempted to thereby suppress the non-recording material-contacting area's temperature rise. In addition, it is described that a porous elastic layer is provided in the lower layer of the elastic layer to lower the thermal conduction in the thickness direction of the elastic layer, and the shortening of the warm-up time can also be expected.

SUMMARY OF THE INVENTION

The pressurizing member according to Japanese Patent Application Laid-Open No. 2002-351243 can surely balance the suppression of the non-recording material-contacting area's temperature rise with the lowering of the thermal conduction of the pressurizing member. However, the pressurizing member has a layered structure of a layer for suppressing the non-recording material-contacting area's temperature rise and a layer for reducing the thermal conduction in a thickness direction, which becomes a factor of increasing a manufacturing cost of the pressurizing member.

Thus, the present invention is directed to providing a pressure rotating member which can be used for a pressurizing member that can suppress the non-recording material-contacting area's temperature rise and can shorten the warm-up time to be needed for being heated to a sufficient temperature for fixing an unfixed toner, while having a simpler structure, and to provide a method for manufacturing the same.

Further, the present invention is directed to providing a heating device for an electrophotographic image-forming apparatus which can stably form a high-grade electrophotographic image regardless of the size of paper.

According to one aspect of the present invention, there is provided a pressure rotating member which is used in a thermal fixing apparatus, and includes a substrate and an elastic layer provided on the substrate and has a void, wherein the elastic layer contains a needle-shaped filler, and wherein a thermal conductivity $\lambda 1$ of the elastic layer in a direction along a rotary axis of the pressure rotating member is 6 times or more and 900 times or less of a thermal conductivity $\lambda 2$ of the elastic layer in a thickness direction.

According to another aspect of the present invention, there is provided a heating device which includes a heating member and a pressurizing member that is arranged so as to face the heating member and is brought into pressure contact with the heating member, the heating device heats a material to be heated by introducing the material to be heated into a nip portion between the heating member and the pressurizing member, clamping and conveying the material to be heated therethrough, wherein the pressurizing member is the aforementioned pressure rotating member.

According to further aspect of the present invention, there is provided a method for manufacturing a pressure rotating member of a thermal fixing apparatus, which comprises the steps of:

(1) flowing a liquid composition in an emulsion state for forming an elastic layer in a longitudinal direction of a substrate, the liquid composition containing an uncrosslinked rubber, a needle-shaped filler and a water-containing gel, and forming a layer of the liquid composition on the substrate;
(2) cross-linking the uncrosslinked rubber in the layer of the liquid composition; and
(3) evaporating a water content in the water-containing gel from the layer which is formed by the cross-linking of the uncrosslinked rubber, and forming an elastic layer having a void therein.

According to the present invention, a pressure rotating member which achieves the shortening of the warm-up time while suppressing the non-recording material-contacting area's temperature rise can be obtained. Furthermore, according to the present invention, a heating device which resists causing the non-recording material-contacting area's temperature rise, and can efficiently heat a body to be heated can be obtained.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A pressure rotating member according to the present invention will be specifically described below.

(1) Heating Device

Figure 1:
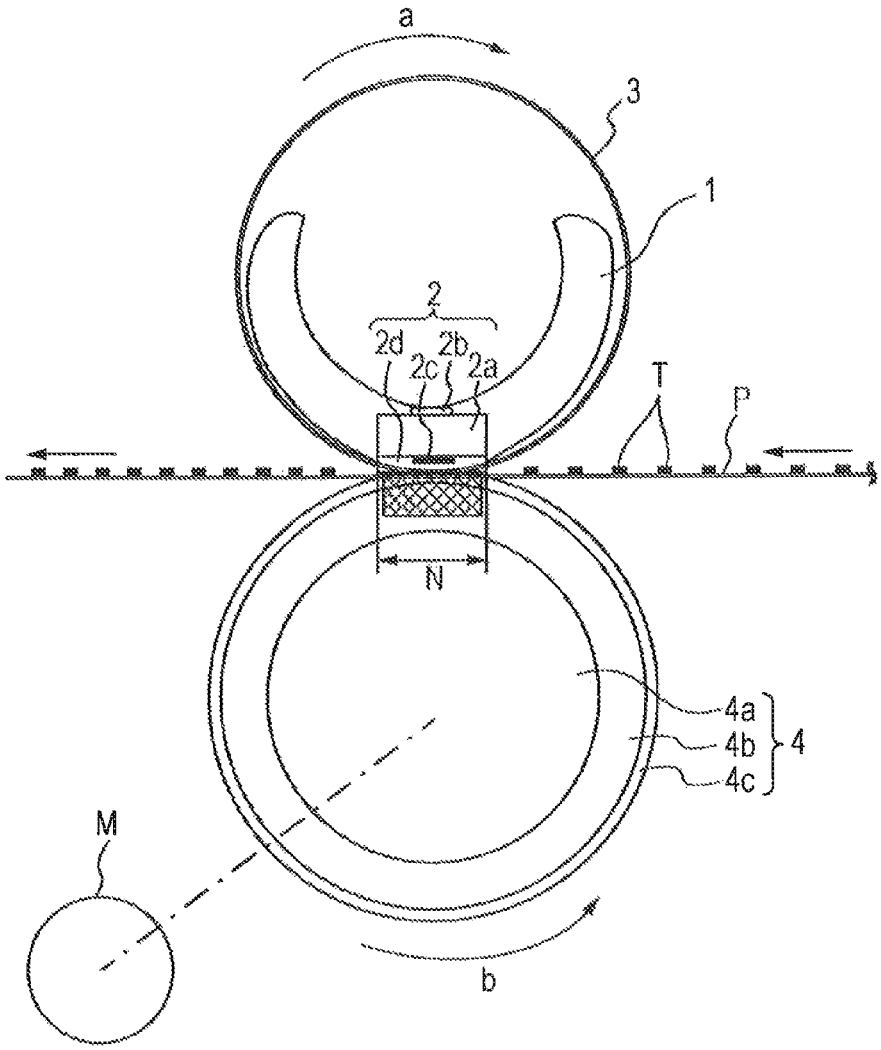
FIG. 1 is a schematic block diagram of a heating device according to the present invention.

FIG. 1 is a sectional view of a heating device according to the present invention. This heating device is a film heating type of heating device, and the structure of the outline will be described below.

In FIG. 1, a horizontally-long film guide member 1 is shown which has an approximately semicircular arc and trough shape in the cross section, and of which direction parallel to the longitudinal direction of the substrate is set to be a cross direction. A horizontally-long heater (heating unit which is one component that constitutes heating member) 2 is shown which is accommodated and held in a groove that is formed approximately in the middle of the lower face of the film guide member 1 along the cross direction. A film-shaped endless belt 3 is shown (which will be hereafter described as a film). The film 3 has a cylindrical shape and is loosely slipped over the film guide member 1 having the heater 2 fitted therein. The film guide member 1 is, for instance, a molded product formed from a heat resistant resin such as PPS (polyphenylene sulfide) and a liquid crystal polymer.

The heater 2 has a structure in which a heat-generating resistor is provided on a ceramic substrate. The heater 2 illustrated in FIG. 1 has a horizontally long and thin-sheet shaped heater substrate 2*a* of alumina or the like, and a wire shaped or thin-strip shaped energization exothermic body (heat-generating resistor) 2*c* of Ag/Pd or the like, which is formed and provided on the surface side (film sliding surface side) in the longitudinal direction of the substrate. In addition, the heater 2 has a thin surface-protection layer 2*d* such as a glass layer, which covers and protects the energization exothermic body 2*c*. Then, a temperature-measuring element 2*b* such as a thermistor is in contact with the rear face side of the heater substrate 2*a*. This heater 2 can be controlled so that a predetermined fixing temperature (target temperature) is kept by a power control unit (not shown) including the temperature-measuring element 2*b*, after the temperature has been promptly raised by a power supply for the energization exothermic body 2*c*.

The film 3 is, for instance, a composite layer film formed of a base film coated with a surface layer on the surface, or the like. This film can have a film thickness of 100 μm or less in total, and further can have a film thickness of 20 μm or more and 60 μm or less in total, so as to decrease its heat capacity and enhance the quick-starting property of the heating device.

Materials to be used for the base film are resin materials Such as PI (polyimide), PAI (polyamide-imide), PEEK (polyether ether ketone) and PES (polyether sulphone), and metal materials such as SUS and Ni.

Materials to be used for the surface layer are fluororesin materials such as PTFE (polytetrafluoroethylene), PFA (tetrafluoroethylene-perfluoroalkylvinyl ether) and FEP (tetrafluoroethylene-hexafluoropropylene).

Incidentally, an elastic layer formed of a silicon rubber or an adhesive layer may be appropriately provided between the base film and the surface layer.

A pressure rotating member 4 is shown which is arranged so as to face the lower face of the heater 2 while clamping the film 3, is brought into pressure contact with the heater 2, and functions as a pressurizing member. Incidentally, the heater 2 and the film 3 are components which constitute the heating member, and the heater 2 functions as a heating unit for the film 3.

The pressure rotating member 4 is pressurized against the surface protection layer 2*d* of the heater 2 through the film 3 with a predetermined pressurizing force, by a predetermined pressuring mechanism (not shown). The elastic layer 4*b* of the pressure rotating member 4 is elastically deformed according to the pressurizing force, and a nipping portion N having a predetermined width necessary for heating and fixing an unfixed toner image is formed between the surface of the pressure rotating member 4 and the surface of the film 3.

A recording material P which is the material to be heated is introduced into the nipping portion N, the recording material P is clamped and conveyed, and thereby the recording material P is heated. A period of time during which the film 3 is in contact with the pressure rotating member 4 in the nipping portion N is generally approximately 20 to 80 msec.

The pressure rotating member 4 is rotationally driven in a counterclockwise direction that is shown by the arrow b, at a predetermined peripheral velocity, by a driving force of a driving source M, which is transmitted to the pressure rotating member through a power transmission mechanism such as a not-shown gear.

The pressure rotating member 4 is rotationally driven in the counterclockwise direction which is shown by the arrow b, when image formation is executed, and thereby the film 3 follows the rotation of the pressure rotating member 4 and is rotated in a direction which is shown by the arrow a.

(2) Layer structure of pressure rotating member

The layer structure of the pressure rotating member 4 will be described in detail below.

Figure 2:
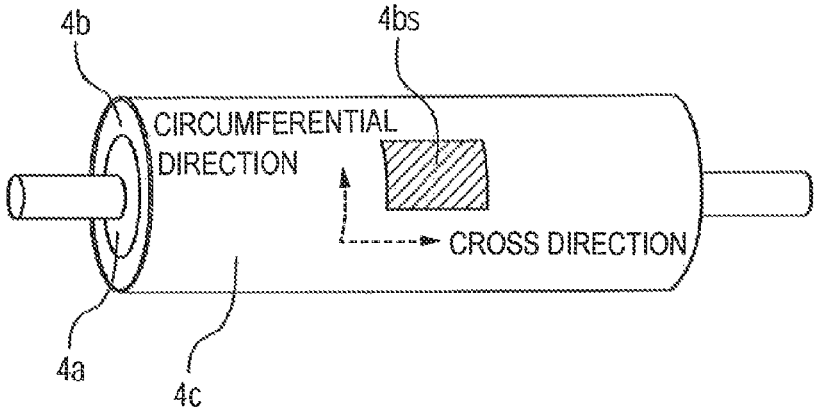
FIG. 2 is an overhead view of a pressure rotating member according to the present invention.

FIG. 2 is an overhead view of the pressure rotating member 4. In FIG. 2, a substrate 4*a* is a substrate formed from iron, aluminum or the like, an elastic layer 4*b* is an elastic layer containing a silicone rubber, and a releasing layer 4*c* is a releasing layer formed from a fluororesin or the like.

The elastic layer 4*b* is formed of a single layer, and has needle-shaped fillers 4*b*1 which are oriented in the cross direction of the substrate 4*a* and a void 4*b*2 therein. The thickness of the elastic layer 4*b* is not limited in particular as long as the nipping portion having a desired width can be formed, but can be 2 to 10 mm. The elastic layer 4*b* can contain a cured substance of an addition-curing-type silicone rubber.

The thickness of the releasing layer 4*c* is generally 20 to 50 μm which can give sufficient releasing properties to the pressure rotating member 4 and can be arbitrarily set in such a range as not to impair an effect according to the present invention.

(3) Elastic layer of pressure rotating member

An elastic layer which constitutes the pressure rotating member of the present invention has the features described below, and accordingly can achieve the shortening of the warm-up time, while suppressing the non-recording material-contacting area's temperature rise.

(Ratio of thermal conductivity λ1 in direction along rotary axis to thermal conductivity λ2 in thickness direction)

A thermal conductivity λ1 of the elastic layer according to the present invention in a direction along a rotary axis of the pressure rotating member (hereinafter also simply referred to as a "rotary axis") is 6 times or more and 900 times or less of a thermal conductivity λ2 of the elastic layer in the thickness direction. In other words, "λ1/λ2" (which is hereinafter described as a thermal conductivity ratio α) is 6 or more and 900 or less. The thermal conductivity ratio α can be 6 or more and 335 or less, in particular.

When the thermal conductivity ratio α of the elastic layer is set within the above-described range, a pressure rotating member can be obtained in which the flexibility of the elastic layer is kept, and an effect for suppressing the non-recording material-contacting area's temperature rise and the shortening of the warm-up time are balanced at a high level.

On the other hand, when the thermal conductivity ratio α is less than 6, it becomes difficult to balance the effect of suppressing the non-recording material-contacting area's temperature rise and the shortening of the warm-up time, at a high level. In addition, in order to make the thermal conductivity ratio α of the elastic layer exceed 900, it is necessary to extremely increase the thermal conductivity of the elastic layer in the direction along the rotary axis by making the elastic layer contain a large amount of the needle-shaped fillers, or to extremely decrease the thermal conductivity of the elastic layer in the thickness direction by making a large number of voids exist in the elastic layer. However, if the large amount of the needle-shaped fillers is added to the elastic layer and the large amount of the voids is made to exist in the elastic layer, an abundance ratio of a rubber component in the elastic layer results in decreasing. This causes the lowering of the elasticity of the elastic layer, and occasionally lowers the transportability of the material to be recorded in a fixing nip.

The thermal conductivity ratio α in the above-described range can be achieved by the elastic layer which has the needle-shaped fillers that are oriented approximately in a direction along the rotary axis, and has the void existing therein.

The elastic layer 4*b* will be described in more detail below with reference to FIG. 3 to FIG. 5B.

Figure 3:
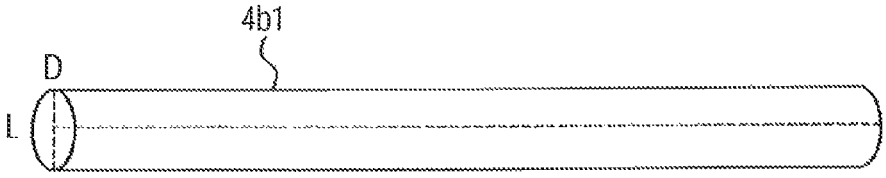
FIG. 3 is a schematic view of a needle-shaped filler.

FIG. 3 is an enlarged perspective view of the needle-shaped filler 4*b*1 which exists in the elastic layer 4*b* while being oriented in the longitudinal direction of the substrate and has a diameter D and a length L. Incidentally, the physical properties and the like of the needle-shaped filler 4*b*1 will be described later.

Figure 4:
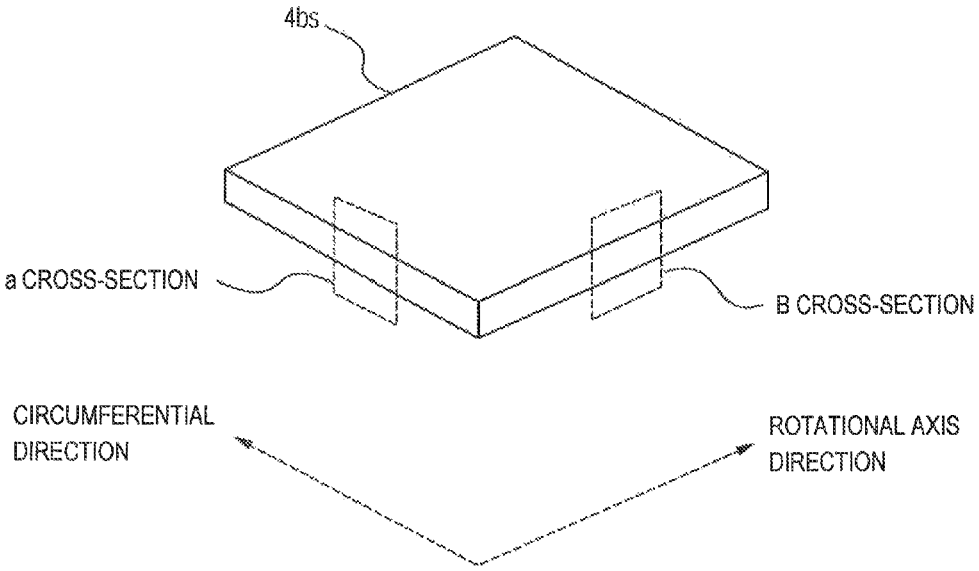
FIG. 4 is an enlarged perspective view of a sample which has been cut out from an elastic layer.

FIG. 4 is an enlarged perspective view of a cut-out sample 4*bs* which has been cut out from the elastic layer 4*b* in FIG. 2. The cut-out sample 4*bs* is cut out along the cross direction and the circumferential direction, as is illustrated in FIG. 2.

Figure 5A:
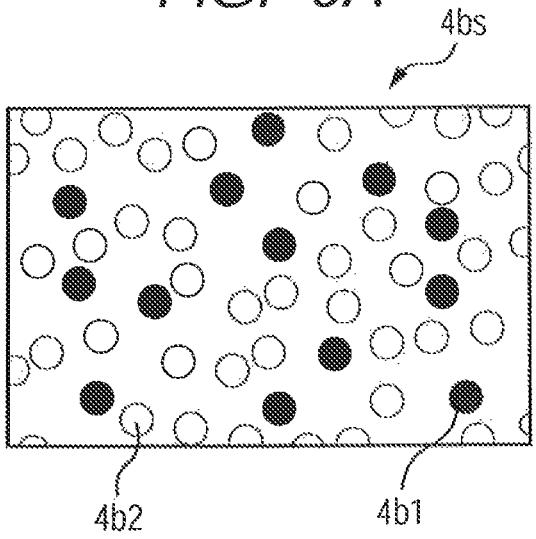
FIG. 5A is an enlarged view of a cross section in a circumferential direction (a cross-section) of the sample which has been cut out from the elastic layer.
Figure 5B:
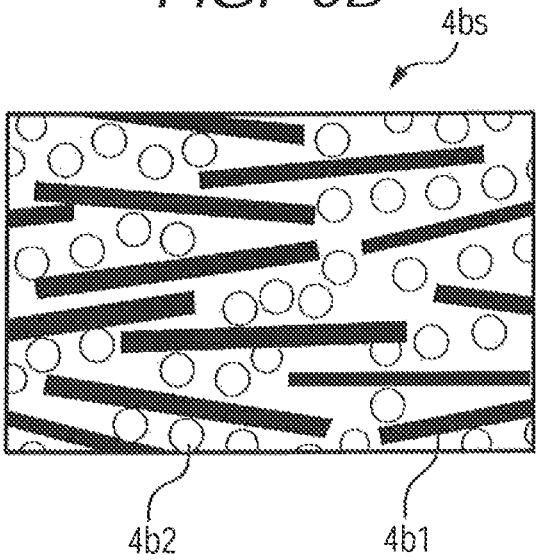
FIG. 5B is an enlarged view of a cross section in a cross direction (b cross-section) of the sample which has been cut out from the elastic layer.

FIG. 5A is an enlarged view of the cross section in the circumferential direction (a cross-section) of the cut-out sample 4*bs*, and FIG. 5B is an enlarged view of the cross section in the cross direction (b cross-section) of the cut-out sample 4*bs*. In the cross section in the circumferential direction (a cross-section), the cross sections with the diameter D of the needle-shaped fillers 4*b*1 can be mainly observed, as is illustrated in FIG. 5A, and in the cross section in the cross direction (b cross-section), portions with the length L of the needle-shaped fillers 4*b*1 can be mainly observed, as is illustrated in FIG. 5B. The needle-shaped filler 4*b*1 which is oriented to the direction along the rotary axis of the pressure rotating member becomes a thermal conduction path, and can enhance the thermal conductivity in the direction along the rotary axis.

In addition, the void 4*b*2 can be observed in both of FIG. 5A and FIG. 5B. Thus, the elastic layer 4*b* shows high thermal conductivity in the cross direction due to the needle-shaped fillers 4*b*1 which are oriented to the cross direction and the void 4*b*2, and the elastic layer 4*b* shows low thermal conductivity in the thickness direction due to the void. In addition, the apparent density can be lowered by the void, and accordingly a volumetric specific heat can be reduced. Incidentally, the apparent density means a density based on a volume including the void.

The thermal conductivity λ1 of the elastic layer according to the present invention in the direction along the rotary axis can be 2.5 W/(m-K) or more and 90.5 W/(m-K) or less. The reason is because such a numerical value can attain the elastic layer without the addition of an excessively large amount of the needle-shaped fillers to the elastic layer, in other words, while sufficiently keeping the elasticity of the elastic layer.

Incidentally, the thermal conductivity ratio α can be determined in the following way. Firstly, the sample 4*bs* is cut out from the elastic layer of the pressure rotating member 4 with a razor. This sample 4*bs* is measured for the thermal conductivity λ1 of the elastic layer in the direction along the rotary axis, and the thermal conductivity λ2 of the elastic layer in the thickness direction, in the following way. Each of the thermal conductivities is measured five times, and a ratio of the thermal conductivities is calculated with the use of those average values.

Figure 6:
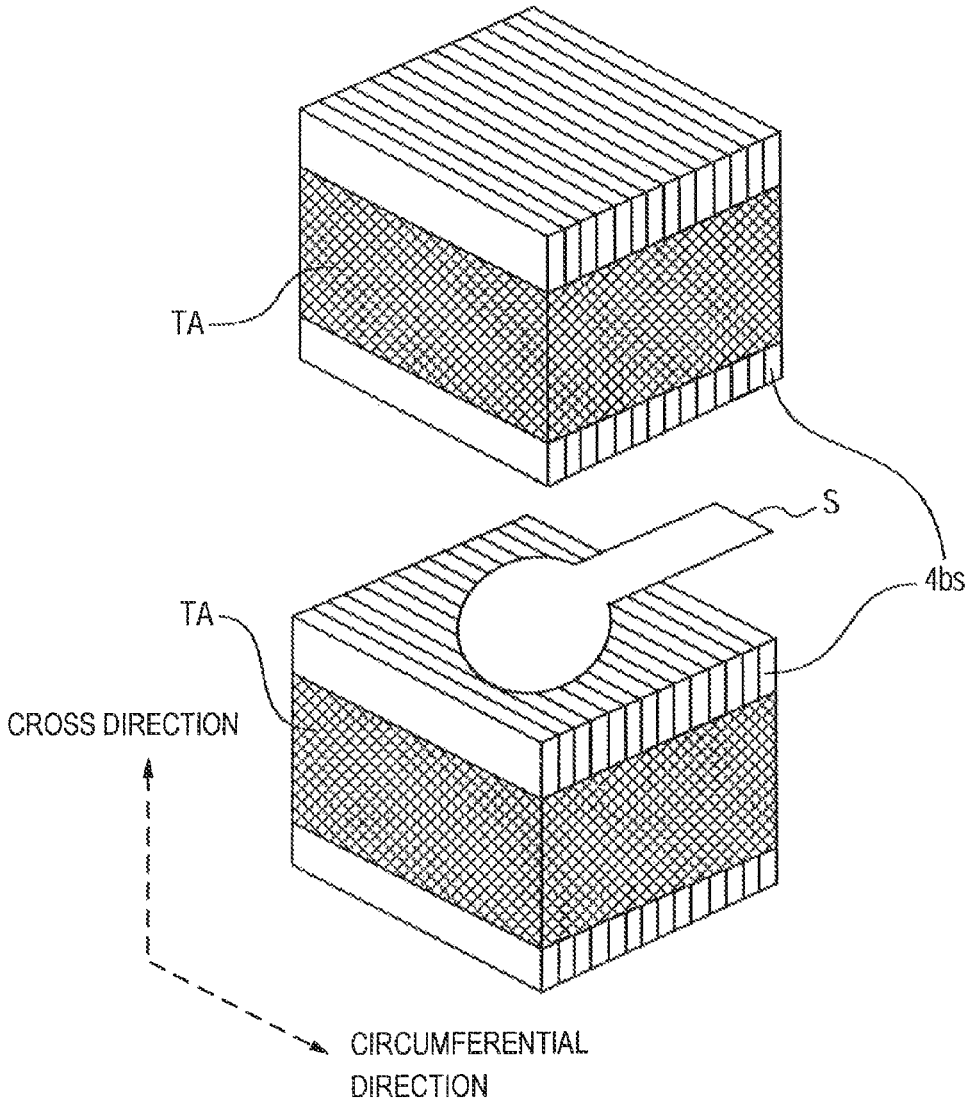
FIG. 6 is an explanatory drawing of a method for measuring the thermal conductivity of the sample which has been cut out from the elastic layer.

A method for measuring the thermal conductivity λ1 and the thermal conductivity λ2 will be described below with reference to FIG. 6. FIG. 6 is a sample for the evaluation of the thermal conductivity (hereinafter described as a sample to be measured), which has been produced so as to have a thickness of approximately 15 mm by overlaying the samples 4*bs* that have been each cut out into circumferential direction (15 mm)×cross direction (15 mm)×thickness (thickness of elastic layer). When the thermal conductivity λ1 is measured, as is illustrated in FIG. 6, the sample to be measured was fixed with an adhesive tape TA having a thickness of 0.07 mm and a width of 10 mm. Next, in order to equalize the flatness of the surfaces to be measured, the surface to be measured, and the rear face of the surface to be measured, which faces the surface to be measured, are cut with a razor. Two sets of the samples to be measured are prepared, a sensor S is clamped by the samples to be measured, and the thermal conductivity is measured. The measurement is anisotropic thermal conductivity measurement with the use of a hot disk-method thermophysical properties analyzer TPA-501 (made by Kyoto Electronics Manufacturing Co., Ltd.). In the measurement of the thermal conductivity λ2, the direction of the sample to be measured was changed, and the sample to be measured was measured in a similar method to the above.

(Volumetric specific heat in region from surface of elastic layer 4*b* to depth of 500 μm)

In the elastic layer according to the present invention, a volumetric specific heat in a region from the surface of the elastic layer 4*b* to the depth of 500 μm can be 0.5 J/cm$^3$-K or more and 1.2 J/cm$^3$-K or less.

As the volumetric specific heat is low, the warm-up time can be shortened, and accordingly the volumetric specific heat can be 0.5 J/cm$^3$-K or more and 1.0 J/cm$^3$-K or less. In the nipping portion, the pressure rotating member is heated by the heating member, usually in an extremely short period of time. Specifically, the period of time is, for instance, approximately 20 to 80 msec. Because of this, it is considered that a heat penetration distance of the heat which the pressure rotating member receives from the heating member is shallow, and is limited in a range from the surface of the elastic layer 4*b* to the depth of approximately 500 μm.

Thus, by decreasing the volumetric specific heat in the region ranging from the surface of the elastic layer to the depth of 500 μm, the penetration of the heat to the pressure rotating member from the fixing film can be suppressed, and the temperature of the film 3 can be efficiently raised. As a result, the warm-up time of the heating member can be shortened.

When the volumetric specific heat in the above-described region is set at 0.5 J/cm$^3$-K or more, the amount of a void in the above-described region does not need to be excessively increased, and the above-described region can have a sufficient strength. In addition, when the volumetric specific heat in the above-described region is set at 1.2 J/cm$^3$-K or less, an effect of further shortening the warm-up time of the heating device can be obtained.

The volumetric specific heat in the region ranging from the surface of the elastic layer 4*b* to the depth of 500 μm in the pressure rotating member 4 can be determined in the following way. First, an evaluation sample (not shown) is cut out from the elastic layer of the pressure rotating member 4 so that the cut out position ranges from the surface of the elastic layer to the depth of 500 μm. Subsequently, specific heat at constant pressure and specific gravity by a liquid immersion method are measured. The specific heat at constant pressure can be determined, for instance, with a differential scanning calorimeter (trade name: DSC823e, made by Mettler-Toledo International Inc.). In addition, the apparent density can be determined, for instance, with the use of a liquid immersion specific gravity measurement apparatus (SGM-6, made by Mettler-Toledo International Inc.). The volumetric specific heat can be determined from thus measured specific heat at constant pressure and apparent density, by the following expression.

$$\text{Volumetric specific heat} = \text{specific heat at constant pressure} \times \text{apparent density}$$

Next, the base polymer and the needle-shaped filler which are contained in the elastic layer 4*b* in FIG. 1 and the void existing in the elastic layer 4*b* will be described in detail below.

(Base Polymer)

The base polymer of the elastic layer 4*b* is obtained by the cross-linking and curing of an addition-curing-type liquid silicone rubber. The addition-curing-type liquid silicone rubber is an uncrosslinked silicone rubber which has organopolysiloxane (A) that has an unsaturated bond such as a vinyl group, and organopolysiloxane (B) that has a Si—H bond (hydride). The Si—H causes an addition reaction with the unsaturated bond such as the vinyl group by heating or the like, and thereby the curing by cross-linking progresses.

It is common that a platinum compound is added to (A) as a catalyst for promoting the reaction. The flowability of this addition-curing-type liquid silicone rubber can be adjusted in such a range as not to impair the object of the present invention. Incidentally, in the present invention, a filler, a filling material and a compounding ingredient which are not described in the present invention, may be included in the elastic layer 4*b* as a well-known unit for solving the problem, as long as the substances do not go beyond the scope of the features of the present invention.

(Needle-Shaped Filler)

The content ratio of the needle-shaped filler 4*b*1 in the elastic layer 4*b* can be set at 5 vol % or more with respect to the elastic layer. When the content ratio of the needle-shaped filler is set at 5 vol % or more, the thermal conductivity of the pressure rotating member in the direction along the rotary axis can be further enhanced, and an effect of further suppressing the non-recording material-contacting area's temperature rise can be obtained. In addition, the content ratio of the needle-shaped filler 4b1 in the elastic layer 4b can be set at 40 vol % or less. When the content ratio of the needle-shaped filler is set at 40 vol % or less, the elastic layer 4b can be easily formed. In addition, the elasticity of the elastic layer can be prevented from being excessively lowered.

As is illustrated in FIG. 3, a material can be used which has a large ratio of the length L to the diameter D of the needle-shaped filler, in other words, which has a high aspect ratio. The shape of the bottom face of the needle-shaped filler may be any of a circular shape and an angular shape.

The needle-shaped filler which has the thermal conductivity λ of 500 W/(m-K) or more and 900 W/(m-K) or less can be used because of being capable of more effectively suppressing the non-recording material-contacting area's temperature rise.

Specific examples of such a material include a pitch-based carbon fiber. The needle-shaped pitch-based carbon fiber can have a shape, for instance, with the diameter D of 5 to 11 μm (average diameter) in FIG. 3 and the length L (average length) of approximately 50 μm or more and 1,000 μm or less, as a more specific shape. The carbon fiber is easily industrially available.

Incidentally, the content, the average length and the thermal conductivity of the above-described needle-shaped filler can be determined in the following way.

As for a method for measuring the content (vol %) of the needle-shaped filler in the elastic layer, firstly, a sample is cut out from the elastic layer, and the volume at 25° C. is measured (this volume is hereafter described as $V_{all}$) with an immersion specific gravity measurement apparatus (SGM-6, made by Mettler-Toledo International Inc.). Next, the evaluation sample of which the volume has been measured is heated at 700° C. for one hour in an atmosphere of nitrogen gas, with the use of a thermogravimetric analyzer (trade name: TGA851e/SDTA, made by Mettler-Toledo International Inc.), and thereby the silicone rubber component is decomposed and removed. When the elastic layer 4b contains an inorganic filler in addition to the needle-shaped filler, the residue after the decomposition and removal is in such a state that the needle-shaped filler and the inorganic filler are mixed. In this state, the volume at 25° C. is measured (this volume is hereafter described as $V_a$) with a dry-type automatic densimeter (trade name: Accupyc 1330-1, made by SHIMADZU CORPORATION). After that, the residue is heated at 700° C. for one hour in an air atmosphere, and thereby the needle-shaped filler is thermally decomposed and removed. The volume at 25° C. of the remaining inorganic filler is measured (this volume is hereafter described as $V_b$) with a dry-type automatic densimeter (trade name: Accupyc 1330-1, made by SHIMADZU CORPORATION). The weight of the needle-shaped filler can be determined, based on these values, from the following expression.

$$\text{Volume of needle-shaped filler (vol \%)}=\{(V_a-V_b)/V_{all}\}\times 100$$

Incidentally, the average length of the needle-shaped filler is a value obtained by measuring the lengths of at least 1,500 needle-shaped fillers which have been randomly selected, with the use of an optical microscope, and arithmetically averaging the obtained values. Incidentally, the arithmetic average value of the length of the needle-shaped fillers in the elastic layer can be determined in the following way. Specifically, the sample which has been cut out from the elastic layer is baked at 700° C. for one hour in an atmosphere of nitrogen gas, and the silicone rubber component is ashed and removed. In this way, the needle-shaped fillers in the sample can be taken out. At least 100 needle-shaped fillers are randomly selected from the above needle-shaped fillers, the lengths are measured with the use of the optical microscope, and the arithmetic average value is determined.

The thermal conductivity of the needle-shaped filler can be determined from thermal diffusivity measured with a laser flash method thermal constant measuring system (trade name: TC-7000, made by ULVAC-RIKO, Inc.), specific heat at constant pressure measured with a differential scanning calorimeter (trade name: DSC823e, made by Mettler-Toledo International Inc.), and density measured with a dry-type automatic densimeter (trade name: Accupyc 1330-1, made by SHIMADZU CORPORATION), by the following expression.

$$\text{Thermal conductivity}=\text{thermal diffusivity}\times\text{specific heat at constant pressure}\times\text{density}$$

(Void)

The void 4b2 exist in the elastic layer 4b according to the present invention, together with the oriented needle-shaped fillers 4b1.

Here, as for the void diameter of the void in the elastic layer according to the present invention, 80-number % or more of the void which appear on the cut face after the elastic layer has been cut in the thickness direction with a razor or the like can be within a range of 5 to 30 μm. Here, the void diameter of the void means a value of half of the total value of the longest length and the shortest length in the void portion, which are obtained after the cut face has been observed with a scanning electron microscope (for instance, trade name: XL-30, made by FEI, magnification of 100 times) and a predetermined region (for instance, 297×204 pixels) has been subjected to binarization. When 80-number % or more of the voids on the cut face is within the above-described range, the strength of the elastic layer can be sufficiently kept.

Incidentally, even though it is intended to form an elastic layer having the needle-shaped fillers oriented in the direction along the rotary axis and the void therein by injecting a liquid composition which contains a foaming agent and hollow particles into a cast molding die together with the needle-shaped filler, it has been difficult to orient the needle-shaped fillers to the direction along the rotary axis.

This is considered to be because the orientation of the needle-shaped fillers is disordered when the foaming agent foams or because the hollow particles result in obstructing the orientation of the needle-shaped fillers. In other words, it has been conventionally difficult to orient the needle-shaped fillers in the direction along the rotary axis of the pressure rotating member, in the elastic layer having the void therein. Because of this, it has been impossible to adjust the thermal conductivity of the elastic layer in the direction along the rotary axis to 6 times or more of the thermal conductivity of the elastic layer in the thickness direction.

On the other hand, in the elastic layer which is formed with the use of a water-containing gel and has the void therein, the needle-shaped fillers are less hindered from being oriented in the direction along the rotary axis.

Here, the water-containing gel means, for instance, a substance that is obtained by swelling the material with water which absorbs water and can swell, which is described in Japanese Patent Application Laid-Open No. 2002-114860 as "water-absorbing polymer powder."

The water-containing gel is mixed together with a material for forming the elastic layer, the mixture is stirred, and an emulsion liquid composition is prepared. The liquid composition is injected into the cast molding die and is cured.

Thereby, the base polymer can be formed in which water is uniformly and finely dispersed. After that, the water is evaporated from the base polymer, and thereby the elastic layer can be formed in which the fine void is uniformly formed.

Such a water-absorbing polymer powder includes an acrylic acid, a methacrylic acid, polymers of these metal salts, and copolymers and cross-linked bodies thereof. In particular, an alkali metal salt of a polyacrylic acid which gives a water-containing gel that can adequately disperse water in the liquid composition containing the addition-curing-type liquid silicone rubber, and a cross-linked body thereof can be used. Such a water-absorbing polymer includes, for instance, "RHEOGIC 250H" (trade name; made by Toagosei Co., Ltd.) and "BEN-GEL W-200U" (trade name; made by HOJUN Co., Ltd.).

When the emulsion liquid composition is used which has been prepared by using such a water-containing gel, the elastic layer can be formed which has the needle-shaped fillers in the elastic layer oriented in the direction along the rotational axis direction and has the void therein. The present inventors assume the mechanism in the following way.

Specifically, this is considered to be because the water-containing gel which absorbs water and is swelled in the liquid composition to be used for the formation of the elastic layer does not have such a hard shell existing therein that the hollow particle conventionally used as a void-forming unit has, the diameter of the water-containing gel in a dispersed state is approximately 10 to 30 μm, and the water-containing gel less hinders the needle-shaped fillers from being oriented in a direction along a flowing direction of the liquid composition.

A porosity in a region from the surface of the elastic layer 4*b* to the depth of 500 μm can be 10 vol % or more and 70 vol % or less. Furthermore, the porosity of the elastic layer 4*b* can be 20 vol % or more and 70 vol % or less. When the porosity is less than 20 vol %, it is difficult to obtain the above-described effect of shortening the warm-up time, and when it is intended to form the porosity of 70 vol % or more, the molding is difficult. The warm-up time can be shortened as the porosity increases, and the porosity can further be 35 vol % or more and 70 vol % or less.

The porosity in the region from the surface of the elastic layer 4*b* to the depth of 500 μm can be determined by the following expression.

Firstly, an arbitrary portion in the region from the surface of the elastic layer to the depth of 500 μm was cut out with the use of a razor. The volume at 25° C. is measured (the above-described $V_{all}$) with an immersion specific gravity measurement apparatus (SGM-6, made by Mettler-Toledo International Inc.). Next, the evaluation sample of which volume has been measured is heated at 700° C. for one hour in an atmosphere of nitrogen gas, with the use of a thermogravimetric analyzer (trade name: TGA851e/SDTA, made by Mettler-Toledo International Inc.), and thereby the silicone rubber component is decomposed and removed. The amount of a reduced weight at this time is to be represented by $M_p$. When the elastic layer 4*b* contains an inorganic filler in addition to the needle-shaped filler, the residue after the decomposition and removal is in such a state that the needle-shaped filler and the inorganic filler are mixed.

In this state, the volume at 25° C. is measured (the above-described $V_a$) with a dry-type automatic densimeter (trade name: Accupyc 1330-1, made by SHIMADZU CORPORATION). The porosity can be determined from the following expression based on these values. Incidentally, in the calculation, the density of the silicone rubber component was assumed to be 0.97 g/cm$^3$ (this density is hereafter described as $\rho_p$).

$$\text{Porosity (vol \%)}=[\{(V_{all}-(M_p/\rho_p+V_a)\}/V_{all}]\times 100$$

In addition, the porosity of the elastic layer 4*b* can be measured in a similar way to the above description after an arbitrary portion is cut out from the elastic layer 4*b*.

Incidentally, the porosity of the present example adopts the average value for 5 pieces of samples in total, which have been cut out from the above-described arbitrary portions.

(4) Method for manufacturing pressure rotating member

A pressure rotating member which provides an effect of shortening the warm-up time while suppressing the non-recording material-contacting area's temperature rise can be obtained by the following manufacturing method.

(i) Process of Preparing Liquid Composition for Forming Elastic Layer

An uncrosslinked addition-curing-type liquid silicone rubber is blended with the above-described needle-shaped filler 4*b*1 and a water-containing material that is a water-absorbing polymer which contains water and has been formed into a gel form (hereafter referred to also as "water-containing gel"). The addition-curing-type liquid silicone rubber, the needle-shaped filler 4*b*1 and the water-containing gel in predetermined amounts are weighed out, are mixed with the use of a well-known filler mixing and stirring unit such as a planet type of universal mixing stirrer, and a liquid composition in an emulsion state for forming the elastic layer is prepared, in which water is finely dispersed in the addition-curing type of liquid silicone rubber.

(ii) Process of Forming Layer of Liquid Composition

The liquid composition which has been prepared in the above description (i) is injected into a cavity of the cast molding die in which the substrate 4*a* having a surface treated with a primer is arranged.

At this time, the liquid composition is injected into the cavity so that the needle-shaped fillers are oriented in the direction along the rotary axis of the pressure rotating member, in other words, are oriented in the cross direction of the pressure rotating member. Thereby, the needle-shaped fillers 4*b*1 are oriented approximately in the direction along the rotary axis, and can efficiently enhance the thermal conductivity in the direction along the rotary axis.

Figure 7:
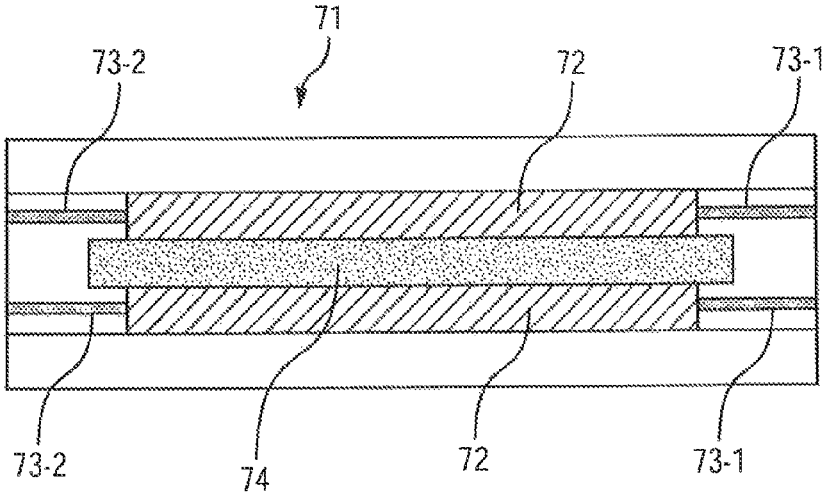
FIG. 7 is a diagrammatic explanatory drawing of a cast molding die for use in the manufacture of a pressure roller.

The specific example will be described below with reference to FIG. 7. FIG. 7 is a sectional view of a cast molding die for a pressure rotating member according to the present invention, in a direction along a longitudinal direction of the substrate. In FIG. 7, there are shown a molding die 71 which has an inner face with a cylindrical shape, a substrate 74 (core bar) of the pressure rotating member according to the present invention, which is arranged in the molding die 71, a cavity 72 which is formed between the outer peripheral face of the core bar 74 and the inner peripheral face of the molding die 71, and communicating paths 73-1 and 73-2 which make the cavity 72 communicate with the outside.

The liquid composition according to the present invention is injected into the inner part of the cavity 72 from the flow channel 73-1, and the inner part of the cavity 72 is filled with the liquid composition. As a result, the needle-shaped fillers 4*b*1 in the liquid composition are oriented approximately in the direction along the longitudinal direction of the substrate, according to the flow of the liquid composition.

The thermal conductivity ratio (λ1/λ2) of the elastic layer can be controlled, for instance, when the elastic layer is formed with a cast molding method, by the adjustment of the content of the water-containing gel in the liquid composition, the length and the content of the needle-shaped filler, the viscosity of the liquid composition, the injection speed into the cavity of the cast molding die, and the like. Specifically, many voids can be made to exist in the elastic layer by increasing the content of the water-containing gel in the liquid composition, and the thermal conductivity ratio ($\lambda 1/\lambda 2$) of the elastic layer can be adjusted toward a direction of being decreased.

The thermal conductivity ratio can be adjusted toward a direction of being increased by increasing the content of the needle-shaped filler in the liquid composition, lengthening the needle-shaped filler, and making the needle-shaped fillers more adequately oriented in the direction along the rotary axis.

It can be achieved to make the needle-shaped fillers more adequately oriented in the direction along the rotary axis, by enhancing the viscosity of the liquid composition, and increasing the inflow velocity of the liquid composition into the cavity of the cast molding die.

(iii) Process of Cross-Linking and Curing Silicone Rubber Component

Next, the cavity which is filled with the liquid composition is sealed and is heated at a temperature lower than the boiling point of water, for instance, at 60 to 90° C., for 5 minutes to 120 minutes, and the silicone rubber component is cured.

Because the cavity is sealed, the silicone rubber component is cured in such a state that the water content in the water-containing gel is kept, which is dispersed in the liquid composition.

On the other hand, when the silicone rubber component is cured in such a state that the cavity is not sealed, the water content in the water-containing gel vaporizes during the process of the curing of the silicone rubber component. As for the thus obtained elastic layer, a region which has no void and no foaming therein (hereinafter described as a "skin layer") is formed in the vicinity of the surface, specifically, in a region from the surface to the depth of 500 μm. This skin layer has higher density than that in the portion of the elastic layer having the void existing therein, and accordingly has higher volumetric specific heat. Specifically, the value (0.5 J/cm$^3$-K or more and 1.2 J/cm$^3$-K or less) of the volumetric specific heat cannot be attained, which can be imparted to the above-described region from the surface to the depth of 500 μm or less. Because of this, the skin layer can be controlled so as not to be formed from the viewpoint of shortening the warm-up time of the heating device. For this purpose, the liquid composition in the emulsion state for forming the elastic layer can be cured so that the water which is finely dispersed in the liquid composition is not evaporated, as has been described above. Specifically, the liquid composition in the emulsion state can be cured in such a state that the cavity is sealed, as has been described above.

(iv) Unmolding Process

After the die has been appropriately cooled with water and air, the substrate 4*a* is unmolded on which the liquid composition layer that has been cross-linked and cured is layered.

(v) Dehydration Process

The liquid composition layer which has been layered on the substrate 4*a* is dehydrated by heat treatment to have the void 4*b*2 formed therein. As for the conditions of the heat treatment, the conditions of 100° C. to 250° C. and 1 to 5 hours are desirable.

(vi) Process of Layering Releasing Layer

The surface of the elastic layer 4*b* is covered and integrated with a tube which is the releasing layer 4*c* and is made from a fluororesin, with the use of an adhesive. When the elastic layer 4*b* and the releasing layer 4*c* are bonded to each other without using the adhesive, the adhesive may not be used. Incidentally, the releasing layer 4*c* does not necessarily need to be formed in the end of the process, but the releasing layer can be layered also with a method of previously arranging the tube in the inner part of the die and casting the liquid composition. In addition, the releasing layer 4*c* can be formed also by a well-known method such as the coating of a fluororesin material, after the elastic layer 4*b* has been formed.

EXAMPLES

The following materials were used in the present example.

Firstly, a core metal made from iron with a diameter of 22.8 mm and a length of 400 mm was prepared, as the substrate 4*a*.

In addition, a water-containing gel was prepared by adding 99 parts by mass of ion-exchanged water to a thickening agent (trade name: "BEN-GEL W-200U", made by HOJUN Co., Ltd.) in an amount of 1 part by mass, which contained sodium polyacrylate as a main component and contained a smectite clay mineral, sufficiently stirring and swelling the mixture.

A PFA tube (made by GUNZE LIMITED) with a thickness of 50 μm was prepared as a material of the releasing layer 4*c*. In addition, four types of pitch-based carbon fibers described below were prepared, as the needle-shaped filler 4*b*1.

<Trade name: XN-100-05M (made by Nippon Graphite Fiber Corporation)>

Average fiber diameter: 9 μm

Average fiber length L: 50 μm

Thermal conductivity of 900 W/(m-K)

This needle-shaped filler is hereafter described as "100-05M."

<Trade name: XN-100-15M (made by Nippon Graphite Fiber Corporation)>

Average fiber diameter: 9 μm

Average fiber length L: 150 μm

Thermal conductivity of 900 W/(m-K)

This needle-shaped filler is hereafter described as "100-15M."

<Trade name: XN-100-25M (made by Nippon Graphite Fiber Corporation)>

Average fiber diameter: 9 μm

Average fiber length L: 250 μm

Thermal conductivity of 900 W/(m-K)

This needle-shaped filler is hereafter described as "100-25M."

<Trade name: XN-100-01Z (made by Nippon Graphite Fiber Corporation)>

Average fiber diameter: 9 μm

Average fiber length L: 1,000 μm

Thermal conductivity of 900 W/(m-K)

This needle-shaped filler is hereafter described as "100-01."

Incidentally, in the present example, an elastic layer 4*b* is bonded to the substrate 4*a*, and the elastic layer 4*b* is bonded to the releasing layer 4*c*, with the following materials, respectively.

A solution (A) and a solution (B) of "DY39-051" (which is the trade name and is made by Dow Corning Toray Co., Ltd.) were used for the bonding of the elastic layer 4*b* and the substrate 4*a*, and a solution (A) and a solution (B) of "SE1819CV" (which is the trade name and is made by Dow Corning Toray Co., Ltd.) were used for the bonding of the elastic layer 4*b* and the releasing layer 4*c*.

Example 1

A liquid composition in an emulsion state was prepared by:

mixing an uncrosslinked addition-curing-type liquid silicone rubber;

the needle-shaped filler "100-25M" in an amount of 10 vol % with respect to the addition-curing-type liquid silicone rubber; and a water-containing gel in an amount of 50 vol % with respect to the addition-curing-type liquid silicone rubber, and stirring the mixture by using a universal mixing stirrer (trade name: T.K. HIVIS MIX 2P-1, made by PRIMIX Corporation) at a rotation speed of the stirring blade set at 80 rpm for 30 minutes. The viscosity of the obtained liquid composition in the emulsion state was 50 Pa-s at a shear rate of 40 (1/second).

The liquid composition was injected and filled into a cavity of a pipe-shaped cast molding die which had the substrate 4*a* treated with a primer installed in the inner part, and had a diameter of 30 mm and a length of 450 mm, as was illustrated in FIG. 7, from a flow channel provided at one end of the cavity, and the die was sealed. The inflow velocity of the liquid composition into the cavity was set at 100 $cm^3$/minute.

Subsequently, the cast molding die was heated at 90° C. in a hot-air oven for 1 hour, and the silicone rubber was cured. After the cast molding die was cooled, the substrate on which a cured silicone rubber layer was formed was taken out from the cast molding die.

The substrate was heated at 200° C. in a hot-air oven for 4 hours, a water content in the cured silicone rubber layer was evaporated, and an elastic layer formed of a single layer was formed in which the needle-shaped fillers were oriented approximately in a direction along the substrate and the void existed.

Subsequently, a pressure roller according to Example 1 was produced by bonding the PFA tube onto the surface of the elastic layer by using the solution (A) and the solution (B) of "SE1819CV" (which is the trade name and is made by Dow Corning Toray Co., Ltd.).

Examples 2 to 8

The type of the needle-shaped filler was changed as was illustrated in Table 1. In addition, the contents of the needle-shaped filler and the water-containing gel in the liquid composition were appropriately increased or decreased so that content ratios of the needle-shaped filler and the void in the elastic layer became values shown in Table 1. Pressure rollers according to Examples 2 to 8 were obtained in a similar way to that in Example 1, except for the above operations.

Comparative Example 1

A liquid composition according to the present comparative example was prepared in a similar way to the liquid composition according to Example 1, except that the needle-shaped filler and the water-containing gel were not mixed. A pressure roller according to Comparative Example 1 was obtained in the same method as that for the pressure roller according to Example 1, except that the above liquid composition was used.

The thus obtained pressure roller according to Comparative Example 1 does not contain the needle-shaped filler in the elastic layer, and does not have also the void existing in the elastic layer.

Example 9

A pressure roller according to Example 9 was produced in a similar way to that in the Example 3, except that a liquid composition was used in which the amount of the water-containing gel in the liquid composition was adjusted so that the content ratio of the void in the elastic layer became 10 vol %.

Example 10

Such a liquid composition was prepared as the liquid composition that 10 vol % of the needle-shaped filler "100-15M" and 10 vol % of a water-containing gel were mixed with respect to an uncured addition-curing-type liquid silicone rubber.

The liquid composition was applied onto the peripheral surface of the substrate by using a doughnut-shaped annular head which had a continuous opening in the inner circumference so that the thickness of the elastic layer became 3.6 mm.

Subsequently, the coating film of the liquid composition on the peripheral surface of the substrate was heated at 50° C. for 72 hours by using an infrared ray lamp while the substrate was horizontally held and was rotated around the substrate, thereby the liquid silicone rubber was cross-linked, and an elastic layer was formed.

After that, a pressure roller according to Example 10 was obtained by bonding a PFA tube onto the elastic layer by using an adhesive (trade name: SE1819CV, made by Dow Corning Toray Co., Ltd.), in a similar way to that in Example 1.

Incidentally, when the cross section of the elastic layer obtained by the above-described method was observed with an optical microscope, a solid layer in which the void did not exist (hereafter also referred to as a "skin layer") was formed in a region from the surface of the elastic layer to the depth of 250 μm.

Comparative Example 2

A pressure roller according to Comparative Example 2 was produced in a similar way to that in Example 9 after a liquid composition was prepared in a similar way to that in Example 9, except that the mixed amount of the needle-shaped filler was set at 15 vol % and a water-containing gel was not added.

(Evaluation of Pressure Roller)

Three portions were randomly selected in each of the elastic layers of the pressure rollers according to Examples 1 to 10, were cut in the thickness direction, and were subjected to the measurement of the sizes of the void which appeared on the cut face. As a result, 80-number % or more of the void had the void diameter of 5 to 30 μm in any cut face.

Subsequently, the pressure rollers of Examples 1 to 10 and Comparative Examples 1 and 2 were each installed in a film heating type of a fixing apparatus, and the temperature of a non-recording material-contacting area and the warm-up time were evaluated.

As for the evaluation of the temperature of the non-recording material-contacting area of the pressure roller, the film heating type of heating devices described in FIG. 1 were used, which mounted the pressure rollers of Examples 1 to 10 and Comparative Examples 1 to 2, respectively.

A peripheral velocity of the pressure roller which was mounted on the heating device was adjusted to 234 mm/sec, and a temperature of the heater was set at 220° C. A letter (LTR) sized paper (75 $g/m^2$) was fed into a nipping portion N of the heating device, as a recording material P which carried a toner T thereon. The paper of 500 sheets were continuously fed so that the longitudinal direction of the paper became parallel to the longitudinal direction of the pressure roller, and the temperature at this time of the surface of the film 3 in a non-recording material-contacting region (region to which the LTR-sized paper did not contact) was measured. The effect of suppressing the temperature rise in the non-recording material-contacting area according to the present invention is that the temperature of the non-recording material-contacting area is lower than that in the heating device which has used the pressure roller of Comparative Example 1, which is provided with a general elastic layer.

As for the evaluation of the warm-up time, a period of time was measured which was spent by the time when the surface temperature of the film 3 reached 180° C. after the heater switch was turned on, in an idling state during which paper was not fed, by using the above-described heating device.

(Result)

The evaluation results (temperature of non-recording material-contacting area and warm-up time) of each pressure roller were shown in Table 1.

In addition, each pressure roller was measured for the content ratio of the void in the elastic layer, the thermal conductivity λ1 of the elastic layer in the direction along the rotary axis, the thermal conductivity λ2 of the elastic layer in the thickness direction, the volumetric specific heat in the region from the surface of the elastic layer to the depth of 500 μm, by the above-described respective methods. The results were shown together in Table 1.

In Example 9, the effect of suppressing the non-recording material-contacting area's temperature rise was observed. On the other hand, the content ratio of the void in the elastic layer is lower than the content ratio of the void in the elastic layers according to Examples 1 to 8, and the volumetric specific heat in the region from the surface of the elastic layer to the depth of 500 μm was high compared to those in the pressure rotating members according to Examples 1 to 8. Because of this, the warm-up time was long compared to those of the pressure rollers according to Examples 1 to 8.

In Example 10, the volumetric specific heat in the region from the surface of the elastic layer to the depth of 500 μm was high compared to that in the pressure rotating members according to Examples 1 to 8, because of having the skin layer formed in a region from the surface of the elastic layer to the depth of 250 μm. Because of this, the warm-up time of the heating device using the pressure roller according to Example 10 was long compared to the cases where the pressure rollers according to Examples 1 to 8 were used.

On the other hand, in Comparative Example 2, the non-recording material-contacting area's temperature rise was significantly suppressed by the existence of the needle-shaped fillers oriented in the direction along the rotary axis. However, the void does not exist in the elastic layer according to Comparative Example 2, and accordingly the thermal conductivity in the thickness direction is high. In addition, the volumetric specific heat in the region from the surface of the elastic layer to the depth of 500 μm is also large, and accordingly Comparative Example 2 has such a structure as to easily remove the heating member of the heat. Because of this, the warm-up time was particularly long compared to the cases where the pressure rollers according to Examples 1 to 10 were used.

TABLE 1

| | Type of needle-shaped filler | Content ratio (vol %) in elastic layer: Needle-shaped filler | Void | Thermal condutivity (W/m-K): λ1 | λ2 | Thermal conductivity ratio (λ1/λ2) | Volumetric specific heat in region from surface of elastic layer to depth of 500 μm (J/cm³ · K) | Non-recording material-contacting area's temperature (° C.) | Warm-up time (second) |
|---|---|---|---|---|---|---|---|---|---|
| Example | 1 ⌈100-25 M⌋ | 10 | 50 | 4.2 | 0.20 | 21 | 0.8 | 280 | 14.1 |
| | 2 ⌈100-05 M⌋ | 5 | 20 | 2.6 | 0.41 | 6 | 1.2 | 285 | 21.3 |
| | 3 ⌈100-15 M⌋ | 5 | 70 | 2.5 | 0.08 | 31 | 0.5 | 288 | 11.6 |
| | 4 ⌈100-15 M⌋ | 25 | 25 | 21.1 | 0.33 | 64 | 1.2 | 260 | 20.5 |
| | 5 ⌈100-15 M⌋ | 5 | 35 | 2.6 | 0.25 | 10 | 1.0 | 287 | 17.8 |
| | 6 ⌈100-01⌋ | 40 | 40 | 90.5 | 0.27 | 335 | 1.0 | 249 | 18.1 |
| | 7 ⌈100-05 M⌋ | 5 | 60 | 2.5 | 0.18 | 14 | 0.6 | 289 | 13.0 |
| | 8 ⌈100-05 M⌋ | 5 | 30 | 2.6 | 0.31 | 8 | 1.1 | 287 | 19.4 |
| | 9 ⌈100-15 M⌋ | 5 | 10 | 2.7 | 0.38 | 7 | 1.4 | 285 | 23.4 |
| | 10 ⌈100-15 M⌋ | 10 | 10 | 4.8 | 0.39 | 12 | 1.5 | 277 | 23.6 |
| Comparative Example | 1 — | 0 | 0 | 0.4 | 0.40 | 1 | 1.5 | 310 | 23.7 |
| | 2 ⌈100-05 M⌋ | 15 | 0 | 9.2 | 1.70 | 5 | 1.6 | 265 | 35.0 |

The pressure rollers which were the pressure rotating members according to Examples 1 to 8 had a thermal conductivity ratio α of 6 or more, and could balance the effect of suppressing the non-recording material-contacting area's temperature rise with an effect of shortening the warm-up time at a high level, due to the needle-shaped fillers which were oriented in the direction along the rotary axis. The volumetric specific heat in the region from the surface of the elastic layer to the depth of 500 μm, in particular, was 1.2 J/cm³-K or less, and accordingly, the effect of shortening the warm-up time was remarkably recognized.

Incidentally, as for Example 2 and Example 3, the needle-shaped filler used in Example 3 is longer than the needle-shaped filler used in Example 2, but values of λ1 of both examples result in being approximately equal. This is considered to be because the amount of voids in the elastic layer of Example 3 is many compared to that in the elastic layer of Example 2, and accordingly the effect of enhancing λ1 is diminished which should be obtained by having used the needle-shaped filler that is long in the direction along the rotary axis.

As has been described above, the pressure rotating member according to the present invention has a reduced thermal conduction in the thickness direction because the elastic layer contains the void, and also has an adequate thermal conduction within a plane of the elastic layer because the needle-shaped fillers in the elastic layer are oriented approximately in the direction along the rotary axis.

As a result, a ratio (λ1/λ2) of the thermal conductivity λ1 of the elastic layer in the direction along the rotary axis of the pressure rotating member to the thermal conductivity λ2 of the elastic layer in the thickness direction could be controlled to 6 or more and 900 or less. Thereby, it is enabled to provide the pressure rotating member which achieves the shortening of the warm-up time while suppressing the non-recording material-contacting area's temperature rise, and the heating device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-007471, filed Jan. 18, 2013, Japanese Patent Application No. 2013-251150, filed Dec. 4, 2013, and Japanese Patent Application No. 2014-003389, filed Jan. 10, 2014, which are hereby incorporated by reference herein in their entirety.

What is claimed is:

1. A pressure rotating member, which is used in a thermal fixing apparatus, the pressure rotating member comprising:

a substrate; and an elastic layer provided on the substrate, wherein the elastic layer has a void, wherein the elastic layer contains a needle-shaped filler, and wherein a thermal conductivity $\lambda 1$ of the elastic layer in a direction along a rotary axis of the pressure rotating member is 6 times or more and 900 times or less of a thermal conductivity $\lambda 2$ of the elastic layer in a thickness direction.

2. The pressure rotating member according to claim 1, wherein a ratio ($\lambda 1/\lambda 2$) of the thermal conductivity $\lambda 1$ of the elastic layer in the direction along the rotary axis of the pressure rotating member to the thermal conductivity $\lambda 2$ of the elastic layer in the thickness direction is 6 or more and 335 or less.

3. The pressure rotating member according to claim 1, wherein:

in the elastic layer, a volumetric specific heat in a region ranging from a surface of the elastic layer to a depth of 500 μm, is 0.5 $J/cm^3$-K or more and 1.2 $J/cm^3$-K or less.

4. The pressure rotating member according to claim 1, wherein a content ratio of the needle-shaped filler in the elastic layer is 5 vol % or more and 40 vol % or less with respect to the elastic layer.

5. The pressure rotating member according to claim 1, wherein:

in the elastic layer, a porosity in a region ranging from a surface of the elastic layer to the depth of 500 μm, is 10 vol % or more and 70 vol % or less.

6. The pressure rotating member according to claim 1, wherein the elastic layer contains a cured substance of an addition-curing-type silicone rubber.

7. The pressure rotating member according to claim 1, wherein a thermal conductivity of the needle-shaped filler is 500 W/(m-K) or more and 900 W/(m-K) or less.

8. The pressure rotating member according to claim 1, wherein the needle-shaped filler is a carbon fiber.

9. The pressure rotating member according to claim 1, wherein the thermal conductivity $\lambda 1$ is 2.5 W/(m-K) or more and 90.5 W/(m-K) or less.

10. A heating device comprising:

a heating member; and a pressurizing member that is arranged so as to face the heating member and is brought into pressure contact with the heating member, wherein the heating device heats a material to be heated by introducing the material to be heated into a nip portion between the heating member and the pressurizing member, and clamping and conveying the material to be heated therethrough, and wherein the pressurizing member is the pressure rotating member according to claim 1.

11. The pressure rotating member according to claim 5, wherein the porosity is 20 vol % or more and 70 vol % or less.

* * * * *

UNITED STATES PATENT AND TRADEMARK OFFICE

CERTIFICATE OF CORRECTION

PATENT NO. : 9,152,110 B2
APPLICATION NO. : 14/310345
DATED : October 6, 2015
INVENTOR(S) : Jun Miura et al.

It is certified that error appears in the above-identified patent and that said Letters Patent is hereby corrected as shown below:

ON THE TITLE PAGE:

At item (73) Assignee, change "Canon Kabushiki Kiasha, Tokyo (JP)" to -- Canon Kabushiki Kaisha, Tokyo (JP) --

Signed and Sealed this
Seventeenth Day of May, 2016

Michelle K. Lee

Michelle K. Lee
*Director of the United States Patent and Trademark Office*